US005611617A

United States Patent [19]

Reggiani

[11] Patent Number: 5,611,617

[45] Date of Patent: Mar. 18, 1997

[54] LOW-PROFILE AND HOMOGENEOUS-BEAM LIGHTING APPARATUS

[75] Inventor: Fabio Reggiani, Milan, Italy

[73] Assignee: Reggiani, S.p.A. Illuminazione, Milan, Italy

[21] Appl. No.: 408,824

[22] Filed: Mar. 23, 1995

[30] Foreign Application Priority Data

Apr. 1, 1994 [IT] Italy ..... MI94A0638

[51] Int. Cl.[6] ..... F21V 7/12

[52] U.S. Cl. ..... 362/300; 362/220; 362/223; 362/301; 362/346; 362/427

[58] Field of Search ..... 362/217, 220, 362/223, 298, 292, 300, 301, 346, 422, 368

[56] References Cited

U.S. PATENT DOCUMENTS

| | | | |
|---|---|---|---|
| 4,349,866 | 9/1982 | Molnar | 362/300 |
| 4,517,631 | 5/1985 | Mullins | 362/297 |
| 4,616,296 | 10/1986 | Westgaard et al. | 362/301 |
| 4,799,136 | 1/1989 | Molnar | 362/300 |
| 4,891,739 | 1/1990 | Yasuda | 362/297 |
| 5,115,384 | 5/1992 | Loth et al. | 362/298 |

FOREIGN PATENT DOCUMENTS 604343 5/1926 France .

*Primary Examiner*—Ira S. Lazarus
*Assistant Examiner*—Sara Sachie Raab
*Attorney, Agent, or Firm*—Shlesinger, Fitzsimmons, Shlesinger

[57] ABSTRACT

A lighting apparatus comprises a light source (12) and light reflecting surfaces from the source to the surrounding environment. One light reflecting surface (10) distributes light at least partly over a second light reflecting surface (11). The first surface (10) reflects the light rays striking thereon substantially towards regions of the second surface (11) receiving the rays directly from the source with an angle of incidence not greater than 20°; preferentially not greater than 12° and most preferentially of 10°. Advantageously, the second surface (11) is of generally semicircular plan with a substantially diametrical edge and exhibits a radial cavity (29) in the form of a triangular pyramid the base of which is directed towards the light source.

24 Claims, 3 Drawing Sheets

LOW-PROFILE AND HOMOGENEOUS-BEAM LIGHTING APPARATUS

BACKGROUND OF THE INVENTION

The present invention relates to a lighting apparatus having an innovatory double-surface reflector. With lighting apparatus of the known art, a problem that has been felt is that of providing a direction of the luminous beam capable of achieving a spreading effect on the wall or the ceiling close to the apparatus itself. For example, in the case of known wall-fitted apparatus, by directing the light beam against the wall so as to have an indirect environmental lighting, a region of high brightness in the vicinity of the apparatus is obtained, but there is a quick brightness weakening on moving away from the apparatus. The same result is achieved when the light beam is directed towards the ceiling.

In addition, the devices of the known art constructed to supply a light diffusion as homogeneous as possible have a relatively big dimension in the main emission direction, especially if compared with the dimension normal to said direction. This is due to the optical geometrical features in terms of distance between the reflector and light source that are required for a good light diffusion. It is a general object of the present invention to eliminate the above mentioned drawbacks by providing a lighting apparatus having an optimal directional character and enabling an excellent diffusion of the beam so that it is able to impinge on a wall or a ceiling with a diffused light even if the lighting apparatus is disposed close to, or mounted on said wall or ceiling.

SUMMARY OF THE INVENTION

In view of the above object, a lighting apparatus has been envisaged which comprises a light source and light reflecting surfaces from the source to the surrounding environment, one light reflecting surface distributing light at least partly over a second light reflecting surface, characterized in that the first surface reflects the light rays striking thereon substantially towards regions of the second surface receiving the rays directly from the source with an angle of incidence not greater than 20°.

BRIEF DESCRIPTION OF THE DRAWINGS

For better explaining the innovatory principles of the present invention and the advantages it offers as compared with the known art, a possible illustrative embodiment of the invention putting into practice said innovatory principles will be described hereinafter with the aid of the accompanying drawings, in which.

DETAILED DESCRIPTION OF THE INVENTION

Figure 1:
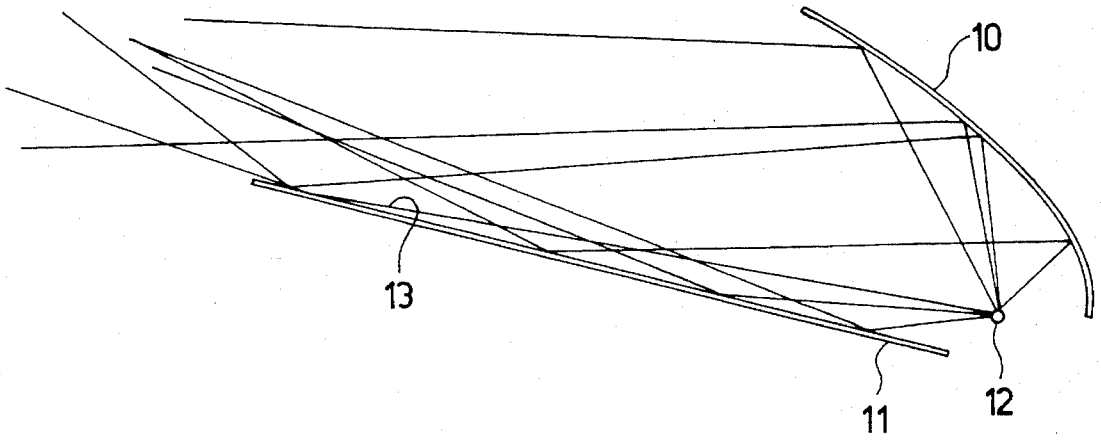
FIG. 1 is a base diagram of a reflector according to the invention.

Referring to the drawings, shown in FIG. 1 is a diagrammatic side view in a median plane of the light ray deflection operated by an innovatory reflector unit according to the invention. As discernible from said figure, the reflector unit substantially consists of two reflective surfaces, identified by 10 and 11 respectively, between which a light source 12 is located.

The two reflective surfaces or reflectors are such shaped and disposed that the first reflective surface 10 distributes light at least partially over the second reflective surface 11, the first surface reflecting the light rays striking thereon substantially onto regions of the second surface receiving the rays directly from the source with an angle of incidence not greater than 20° and in particular in the order of 10°. By the term "angle of incidence" it is intended the angle included between the incident light ray and the surface at the incidence point. In other words, regions of the second reflector that in the absence of the first reflector would not give important contributions to the ray diffusion, are employed to an optimal degree due to the fact that the rays from the first reflector are reflected on said regions. In FIG. 1 this effect can be easily noticed towards the end portion of the second reflector which is farther from the source. For example, the direct ray 13 strikes on surface 11 with a very small (close to 5°) angle of incidence. Striking on the same region however, there is also a ray reflected from the first surface to the second. Advantageously, this second ray has an angle of incidence on the second surface much greater than the first one (in the order of 20°).

The first surface 10 substantially does not direct reflected rays to regions of the second surface where the incident angle of the directed rays is at least greater than 10°. This solution has been found to produce a high homogeneous diffusion of the light rays in the lighting direction, even if the lighting apparatus is embodied in a very "flattened" form.

As clarified in the following, the transverse surface development will vary depending on the real extension of the light source and the amplitude of the solid angle one wishes to illuminate.

For example, the second surface 11 can have an area which is at least twice that of the first surface, so as to produce a light beam of small thickness but great width, which may be useful if one wishes the light beam to impinge on a big surface such as a wall or a ceiling. By virtue of the optical geometrical features of the reflector unit of the invention, the distance between the reflective surfaces can be less than half the width of the major reflective surface, so that the apparatus can keep a flattened shape even with a wide side opening of the light beam.

Figure 4:
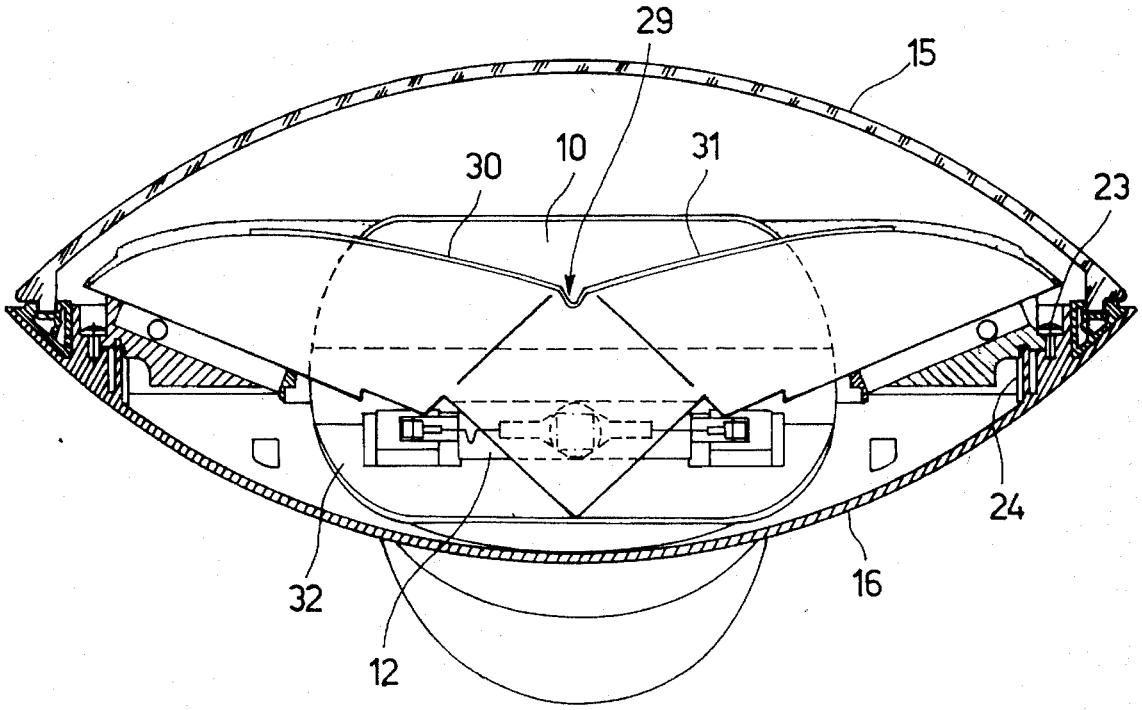
FIG. 4 is a cross-sectional view taken along line IV—IV of FIG. 3.
Figure 2:
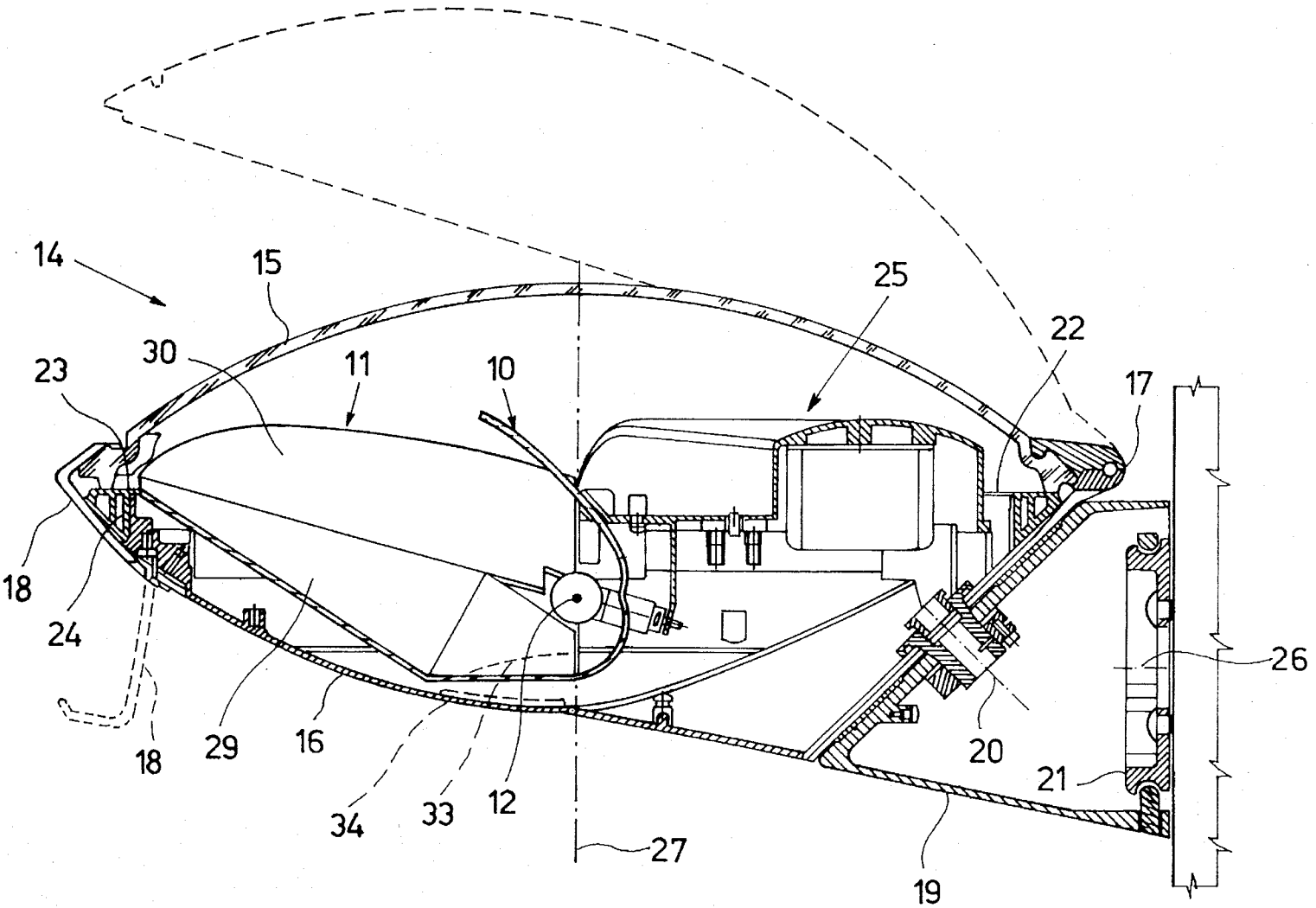
FIG. 2 is a cross-sectional side view taken along line II—II of FIG. 3, of a lighting apparatus applying the inventive principles.
Figure 3:
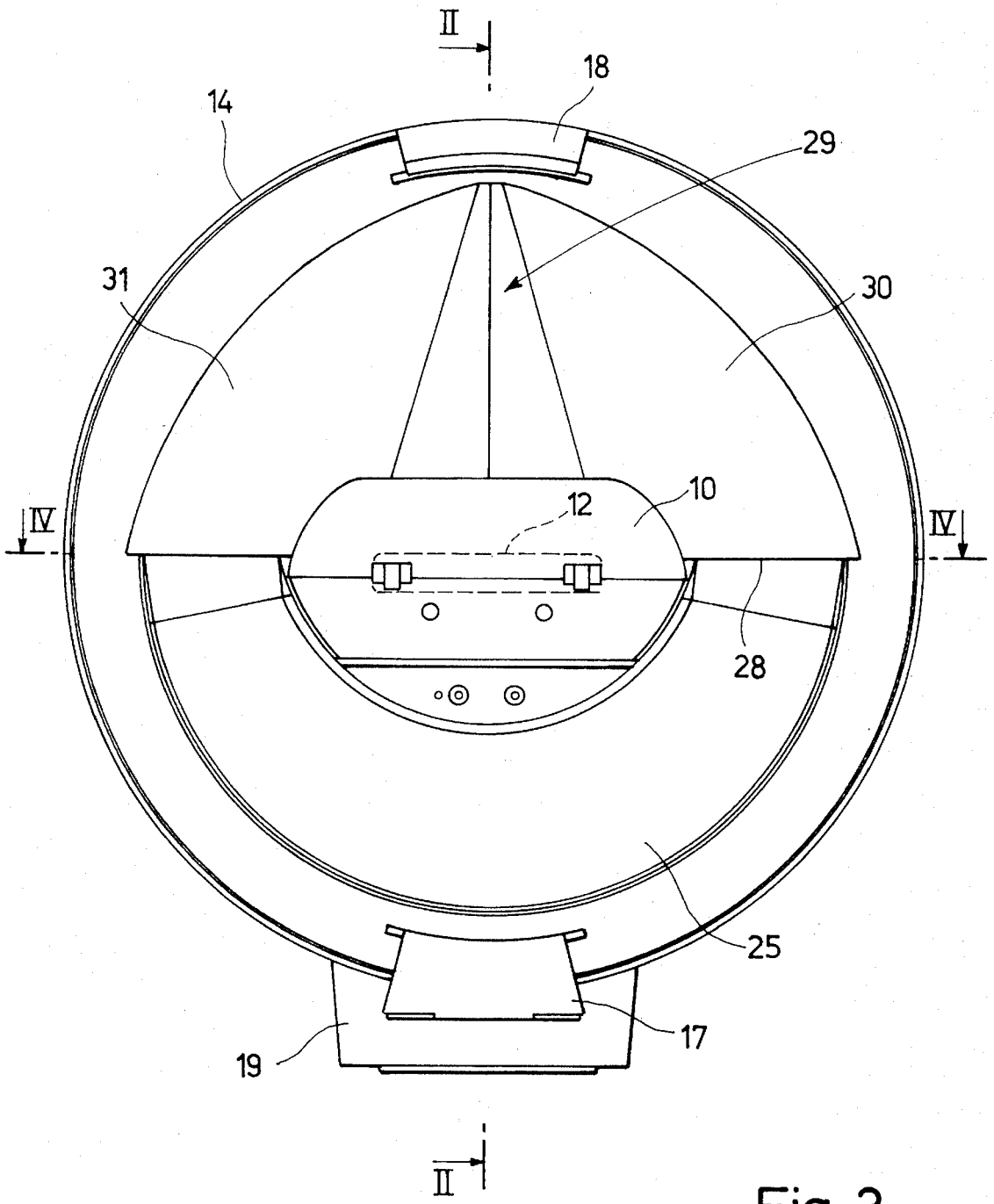
FIG. 3 is a plan view of the apparatus shown in FIG. 2.

Diagrammatically shown in FIGS. 2, 3 and 4 is a possible embodiment of a reflector unit according to the invention and an adjustable lighting apparatus holding it.

As clearly shown in FIG. 2, the lighting apparatus 14 has an external shell of lenticular form comprised of two openable halves 15, 16, hinged at 17 and having a snap-closing hook 18 on the side opposite to the hinge. The lower half 16 is pivotally connected to a bracket 19 enabling fastening of the apparatus to a wall of ceiling, which bracket can also be the free end of a pole supporting the apparatus.

In this manner, the shell can rotate relative to its support bracket according to an axis 20 which is skew to the extension plane of the shell. Advantageously, the bracket enables fastening to a surface at 45° with respect to the rotation axis 20. In addition said bracket is fastened to the surface by a rotating fitting means 21, so that the whole apparatus can rotate about an axis 26 normal to the fastening surface.

Housed in the shell is the reflector unit formed of surfaces 11 and 10 between which the light source 12 is located.

Advantageously, the reflector 11 has a generic extension plane close to the radial extension plane of the lenticular shell and a reflective surface substantially facing the upper half 15 which is made of a material enabling light to pass through, for example transparent plastic material or glass, at least as regards the portion towards which the light beam is directed.

Advantageously, the light source is close to the axis of the lenticular shell and it consists of an elongated lamp the axis of which is radial to the shell. For example, the lamp can be of the halogen type.

As clearly shown in FIG. 2, the reflector unit directs the beam substantially towards the peripheral shell edge. The reflectors can be made to advantage from stamped and shaped plate.

Advantageously, the lamp is located close to the shell axis 27 and the reflector unit and lamp are suspended on the shell by means of a bearing frame 22 having a peripheral rail 23 sliding on a corresponding peripheral rail 24 in the lower half 16. In this manner, the reflector-lamp assembly can be rotated in a plane parallel to the extension plane of the shell and therefore about axis 27, so that the light beam can be addressed to any direction generally radial to the shell by merely rotating the unit inside said shell in a suitable manner.

Advantageously, should the light source need an appropriate electric equipment, such as for example a voltage transformer, intensity regulators, starters, etc., such an equipment (generally denoted at 25) could be supported on the frame 22, so that it would rotate together with the source and always keep behind the reflector unit.

At this point it is obvious that the combination of the rotation movements about axes 20, 26, 27 enables the light beam addressed from the reflecting surfaces to be oriented in a great variety of positions.

From a comparison of FIGS. 2, 3 and 4 the tridimensional shape of the reflective surfaces applying the principles of the invention can be easily detected.

As shown in FIG. 2, the first surface 10 has been made with a generally parabolic development in a plane transverse to the lamp extension, the paraboloid focus being close to the lamp axis.

As viewed from FIG. 3, the second surface 11 has been made with a generally semicircular plan the edge 28 of which is substantially diametrical and parallel to the lamp axis, whereas surface 10 has generatrices substantially parallel to the lamp extension.

In front of the lamp, surface 11 has a radial cavity 29 in the form of a segmental triangular pyramid the base of which is turned towards the diametrical edge 28, the axis being perpendicular to said diametrical edge and therefore the lamp.

Advantageously, the cavity base has an extension at least equal to the extension of the light source.

Said cavity has been found to increase homogeneity in the light diffusion and it also avoids areas of more intense light along the beam axis being formed.

For best results, the reflective side walls of the cavity can be to advantage angled to each other with an angle included between 50° and 130°, in particular of about 90°. In addition, it has been found that it would be convenient for the cavity to taper, moving away from the lamp, with an angle included between 25° and 45°, in particular of about 35°.

The second surface 11 has regions 30, 31 at either side of the cavity that substantially form planes inclined relative to each other towards the first surface 10, advantageously with a mutual angle smaller than 170° and in particularly of about 150°.

As clearly shown in FIGS. 2 and 4, the first surface continues to a third reflective surface 32 extending under the plane of the second surface so as to embrace the lamp and prevent heat radiation towards the inside of the device and parts of the electric equipment.

In an alternative embodiment, the lower portion of the reflector unit can have an opening 33 close to the light source (as diagrammatically shown in dotted line in FIG. 2), at which opening the lower half shell may have a transparent window 34 for diffusing light to the outside. Thus a lighting apparatus can be obtained which has a homogeneous light diffusion on one side and a direct radiation on the other side, which will enable indirect lighting and direct lighting to be combined. The above can be useful for applications requiring particular environmental-lighting solutions.

At this point it is well apparent that the intended purposes have been reached by providing a low-profile and homogeneous-beam lighting apparatus. It has been found for example that with a lighting apparatus as above described a substantially homogeneous illumination of the surface to which the apparatus is fastened can be achieved, even if the surface extends over some meters and the light source is only some ten centimeters therefrom.

In addition, notwithstanding the high adjustability of the light beam, any possibility that the beam may cause dazzling is practically avoided. Due to the thin thickness of the lighting apparatus, it can be embedded, for example in false ceilings, while ensuring in this case too, a correct illumination grazing the ceiling and/or the wall close to the source.

Obviously the above description of one embodiment applying the innovatory principles of the present invention is given for purposes of illustration only and therefore must not be considered as a limitation of the scope of the invention as herein claimed.

For example, the proportions of the different elements may vary depending on pratical requirements, and the conformation of the several parts may be different too, for example in order to obtain different external aesthetic features or more practical embedded devices, as will be obvious to a person skilled in the art.

It is also understood that the light source may have any shape and extension axis. For example, a lamp of the bulb type with axis directed in the cavity 29 direction can be employed.

Depending on the particular source used., the exact conformation of the reflectors can vary, as clear to a person of ordinary skill in the art, in order to obtain the desired illumination and beam-diffusion features. Although the lenticular shape of the shell optimizes the lamp bulkiness, at the same time enabling the reflector unit to be internally swung and adjusted, other forms for the shell may be easily envisaged, also for giving the device another aesthetical feature as desired, while maintaining the adjustability facility of the light beam, for example still by rotating the reflectors according to an axis close to the source and generally directed between the first and second surfaces, as in the case of axis 27 shown in the figures.

Finally, the two reflectors may also be movable relative to each other to enable the beam width to be adjusted.

What is claimed is:

1. A lighting apparatus comprising an elongate light source and light reflecting surfaces receiving light directly from the source and reflecting light to an environment surrounding the apparatus, said surfaces including a first light reflecting surface distributing light at least partly over a second light-reflecting surface, and characterized in that the first surface reflects the light rays striking thereon substantially towards regions of the second surface which receive rays of light directly from the source at an angle of incidence not greater than 20°.

2. The apparatus according to claim 1, characterized in that the angle of incidence is not greater than 12°.

3. The apparatus according to claim 1, characterized in that the first and second surfaces are generally disposed face to face, and the second surface has an area at least twice that of the first surface.

4. The apparatus according to claim 1, characterized in that said first and second surfaces are spaced from each other, and that the distance between the spaced reflective surfaces is less than half the width of one of the reflective surfaces.

5. The apparatus according to claim 1, characterized in that the second surface has a plan of generally semicircular configuration with a substantially diametrically extending edge.

6. The apparatus according to claim 5, characterized in that the light source consists of a lamp of a tubular type having an axis of which is parallel to the diametrically extending edge of the second surface.

7. The apparatus according to claim 1, characterized in that the second surface has a cavity in the shape of a segmental triangular pyramid having a base facing towards the light source.

8. The apparatus according to claim 7, characterized in that the cavity has reflective side walls angled to each other with an angle included between 50° and 130°.

9. The apparatus according to claim 7, characterized in that the shape of the cavity tapers away from the light source, with an angle included between 25° and 45°.

10. The apparatus according to claim 7, characterized in that the cavity base has a length at least equal to the length of the light source.

11. The apparatus according to claim 7, characterized in that the second surface has regions on either side of the cavity that substantially form planes inclined to each other towards the first surface.

12. The apparatus according to claim 11, characterized in that the angle between the planes is smaller than 170°.

13. The apparatus according to claim 1, characterized in that the first surface has a generally parabolic configuration extending in a plane transverse to the length of the light source, the paraboloid focus being close to the source axis.

14. The apparatus according to claim 13, characterized in that the first surface has generatrices substantially parallel to the length of the light source.

15. The apparatus according to claim 1, characterized in that the first surface has a portion thereof.

16. The apparatus according to claim 1, including an external support shell, the first and second surfaces being rotatable inside said shell about an axis adjacent to the light source and generally directed transversely of the first and second surfaces.

17. An apparatus according to claim 1, including an external shell containing said light source and reflecting surfaces, and at least part of the shell facing the second surface being transparent, the first and second surfaces substantially directing light towards the shell.

18. The apparatus according to claim 17, characterized in that the reflective surfaces and light source are supported in the external shell, so that they can rotate in a plane adjacent to the extension plane of the shell.

19. The apparatus according to claim 17, characterized in that the shell is mounted for rotation relative to a support bracket about an axis inclined to the extension plane of the shell.

20. The apparatus according to claim 17, characterized in that the shell is formed of two openable halves linked by a hinge.

21. An apparatus according to claim 17, characterized in that the shell is mounted on a support for rotation relative to the support about an axis perpendicular to a fastening surface of the support.

22. The apparatus according to claim 17, characterized in that the shell is of generally lenticular shape.

23. The apparatus according to claim 22, characterized in that the light source is adjacent to the axis of the lenticular shell.

24. An apparatus according to claim 17, wherein said shell includes a passage to enable escape to the outside of the shell direct light coming from the source.

* * * * *